United States Patent [19]

Reid et al.

[11] 4,018,666

[45] Apr. 19, 1977

[54] PROCESS FOR PRODUCING LOW POUR POINT TRANSFORMER OILS FROM PARAFFINIC CRUDES

[75] Inventors: Lloyd E. Reid, Sarnia; David A. Gudelis, Mississauga, both of Canada

[73] Assignee: Exxon Research and Engineering Company, Linden, N.J.

[22] Filed: July 28, 1975

[21] Appl. No.: 599,690

[52] U.S. Cl. ..... 208/36; 208/33

[51] Int. Cl.[2] ..... C10G 43/08

[58] Field of Search ..... 208/33, 36

[56] References Cited

UNITED STATES PATENTS

| | | | |
|---|---|---|---|
| 2,906,688 | 9/1959 | Farmer et al. | 208/33 |
| 3,503,870 | 3/1970 | Walker | 208/33 |
| 3,627,673 | 12/1971 | Sproule et al. | 208/36 |
| 3,644,195 | 2/1972 | Gudelis et al. | 208/33 |
| 3,681,230 | 8/1972 | Eagen et al. | 208/33 |

*Primary Examiner*—Herbert Levine
*Attorney, Agent, or Firm*—Edward M. Corcoran

[57] ABSTRACT

A very low pour point transformer oil is produced by a process wherein a narrow cut distillate of a paraffinic crude from conventional crude oil atmospheric or vacuum towers is first solvent extracted to remove aromatics and polar components, followed by immiscible solvent dewaxing whereby two liquid and one solid phases form a wax-containing slurry which is filtered to produce a wax cake which contains a high viscosity index oil and a filtrate which contains a very low pour point transformer oil.

16 Claims, 2 Drawing Figures

FIGURE I

SOLUBILITY OF RAFFINATE OIL IN MIXED KETONE SOLVENTS

PROCESS FOR PRODUCING LOW POUR POINT TRANSFORMER OILS FROM PARAFFINIC CRUDES

BACKGROUND OF THE INVENTION

2. FIELD OF THE INVENTION

This invention relates to a method of preparing very low pour point oils suitable for use as transformer oils. More particularly, this invention relates to an improved process for producing low pour point transformer oils from paraffinic crudes.

2. DESCRIPTION OF THE PRIOR ART

Transformer oils are known in the prior art as high stability electrical insulating oils and are also used in other electrical equipment such as circuit breakers. In addition to possessing relatively low viscosity, high dielectric strength and a relatively high flash point, these oils are further characterized in that they must have a relatively low pour point. This is particularly necessary where the oils are to be used in colder climates. Additionally, these oils must be low in corrosive agents such as acid, alkali and sulfur and resistant to oxidation and sludge formation.

Several methods for preparing insulating oils are known in the prior art. In general, they are produced from wax-free naphthenic crude oils which are not native to many parts of the world and consequently command premium prices and involve high transportation costs. Although these crudes permit production of exceptionally low pour point insulating oils without the need for dewaxing or special attention to the degree of fractionation or distillate cut width, they also contain high percentages of sulfur and nitrogen which must be removed in order to satisfy the stringent stability requirements of insulating oils.

Extremely stable insulating oils produced either totally or partially from paraffinic crudes by conventional dewaxing techniques are also used in certain applications where moderate climatic conditions do not demand oils with especially low cloud or pour points. When exceptionally low pour points are required, however, deep dewaxing of paraffinic distillates at temperatures below −40° F cannot compete economically with the manufacture of these oils from naphthenic crudes.

A process which avoids deep dewaxing and produces competitively priced, low viscosity oils with exceptionally low pour points from paraffinic distillates was disclosed in U.S. Pat. No. 2,906,688. In this process a broad, wax-containing fraction is first sharply fractionated to yield a narrow heart cut of suitable viscosity which is then dewaxed at about 0° F to yield a dewaxed oil having a pour point of −50° F, or lower. The narrow cut also may be solvent extracted prior to dewaxing without materially affecting the pour point of the product. The difficulty associated with this process is related to the nature of the low pour point oils produced. Although they have low pour points, their cloud points, which mark the onset of wax precipitation, are relatively high, approximating the dewaxing temperature used in making them. This, in turn, makes the pour point of the product extremely sensitive to waxy contaminants such as paraffin wax, which would certainly be encountered in process lines comprising solvent treating (extraction), hydrofining and dewaxing units which normally operate on relatively high pour point, wax-bearing streams. In fact, it has been found that the addition of as little as 0.5 percent of a paraffin wax to an insulating oil prepared by the aforedescribed process and having a cloud point of −12° F will raise the pour point from −50° F to −5° F, whereas the addition of the same amount of paraffin wax to a wax-free, naphthenic oil having the same viscosity and pour point does not affect the pour point at all.

U.S. Pat. No. 3,627,673 discloses a process for producing low pour point transformer oils from paraffinic crudes which eliminates the highly specialized fractionating tower needed for the initial narrow cut distillate required in U.S. Pat. No. 2,906,688 as well as avoiding the waxy contaminant sensitivity of the product produced by said process. The U.S. Pat. No. 3,627,673 process comprises taking a narrow cut having a 5 to 95 LV (liquid volume) % boiling range between 550° to 750° F from a conventional crude oil vacuum pipe still, solvent extracting, dewaxing and hydrofining the dewaxed raffinate, followed by fractionally distilling the hydrofined dewaxed raffinate to obtain a narrow cut (heart cut) having a 5/95 LV% boiling range of from 580° to 720° F or narrower. However, the fractionating or rerun column required in this process is rather complex and contains a relatively large number of plates therein.

It would be a great improvement to the art if one could obtain low pour point transformer oils from paraffinic crudes without encountering the waxy contaminant sensitivity of the product produced by the process in U.S. Pat. No.2,906,688 and at the same time avoid the necessity of the special fractionating columns required in both the U.S. Pat. Nos. 2,906,688 and 3,627,673 processes.

BRIEF SUMMARY OF THE INVENTION

In accordance with the present invention, a low pour point transformer oil is efficiently and conveniently produced by a process which comprises 1. solvent extracting a waxy distillate fraction of a paraffinic crude, said fraction having a 5 to 95% boiling range of 595° to 755° F at atmospheric pressure to produce an extract and a raffinate;

2. solvent dewaxing said raffinate at a temperature of from about −10° to −40° F under liquid-liquid immiscible conditions to form a three phase slurry containing a solid waxy phase, an oil-rich liquid phase and a solvent-rich liquid phase;

3. filtering said slurry at a temperature of from about −10° to about −40° F to form a filtrate substantially comprising the solvent-rich phase and a wax cake containing most of the oil-rich phase; and 4. recovering a low pour point transformer oil from the filtrate.

The waxy distillate fraction derived from the paraffinic crude may be obtained, as a narrow cut having a 5 to 95% boiling range of from about 595° to 755° F, from a conventional crude oil vacuum pipe still. This distillate is solvent extracted to remove a substantial portion of the aromatic and polar constituents therefrom using conventional extraction solvents such as NMP, phenol, furfural, etc. The dewaxing solvent composition is adjusted so that a three phase slurry is formed from the extracted distillate or raffinate in the dewaxing zone, comprising a solid waxy phase and two immiscible liquid phases, with the low pour point transformer oil being one of the constituents of the solvent-rich liquid phase. Generally, the dewaxing temperature should not be higher than −20° F and the cold slurry is then filtered at about the dewaxing temperature. During the filtration operation, the oil-rich liquid phase behaves like wax and remains on the filter with the wax cake. However, the solvent-rich phase containing the transformer oil passes through the filter as filtrate and the transformer oil is recovered therefrom.

DETAILED DESCRIPTION

Figure 1:
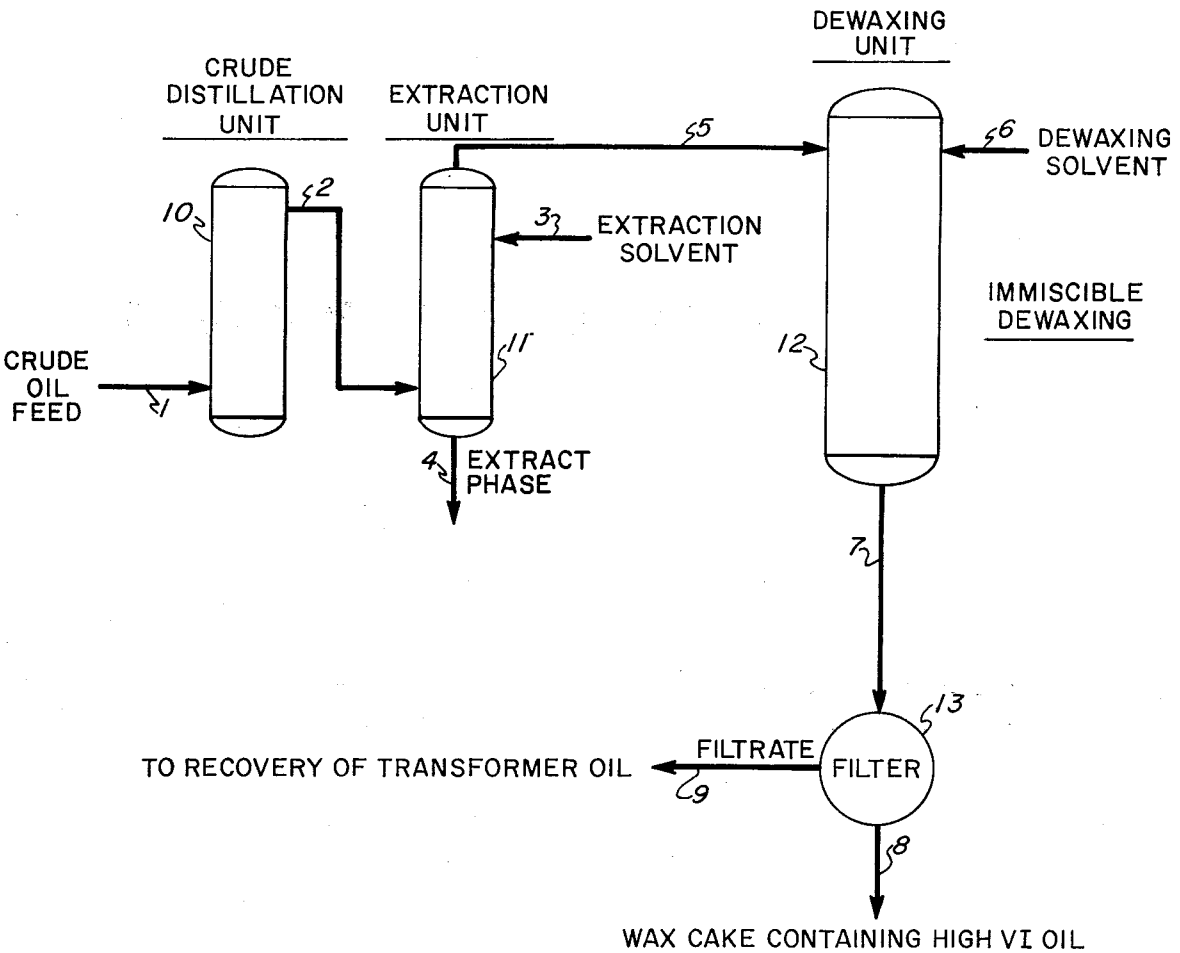
FIG. 1 is a flow diagram of a process for producing low pour point transformer oils in accordance with one embodiment of this invention.

Referring to FIG. 1, a wax-containing paraffinic crude, such as an Aramco crude, is fed into a conventional refinery crude still 10 via line 1, wherein the crude oil is fractionated into several cuts, including a cut having a 5 to 95 LV% boiling range of 595° to 755° F, as measured at atmospheric pressure, which contains the desired transformer oil. The cut containing the transformer oil is taken from the vacuum portion of the crude still 10 through line 2, and transferred to extraction unit 11 wherein the aromatic and polar constituents of the transformer oil fraction are reduced by solvent extraction using conventional extraction solvents such as phenol, furfural, NMP, etc. The extraction solvent enters extraction unit 11 via line 3 wherein it contact the transformer oil cut, the flow of the solvent being preferably countercurrent to the flow of the oil. An extract phase and a raffinate phase are formed in the extraction unit. A substantial portion of the extraction solvent leaves extraction unit 11 via line 4 as a major component of the extract phase which comprises most of the solvent and most of the aromatic and polar constituents of the transformer oil fraction. The raffinate phase containing the desired transformer oil fraction passes overhead thru line 5 to dewaxing unit 12. Cold dewaxing solvent such as a mixture of MEK/-MIBK enters dewaxing unit 12 via line 6 and is admixed with the raffinate therein. The wax content of the raffinate is reduced to the desired level by cooling the solvent/raffinate mixture to a predetermined temperature, such as −25° F, thereby precipitating the wax out of the raffinate. Both the temperature and composition of the dewaxing solvent are adjusted (i.e., 90/10 LV% MEK/-MIBK and −25° F) so as to form a slurry having two liquid phases and one solid waxy phase at the end of the chilling cycle in dewaxer 12. Dewaxer 12 may also comprise one or more scraped surface chillers for further cooling the solvent/raffinate mixture in order to achieve the three phase slurry, if desired. The solid phase comprises the wax while the two liquid phases comprise an oil-rich phase and solvent-rich phase, the latter containing the desirable low pour point (below −40° F) transformer oil. The slurry is passed from the dewaxer 12 to filter 13 via line 7 where the solvent-rich liquid phase is removed as a filtrate thru line 9 and from there sent to means such as solvent strippers (not shown) for separating solvent from the desired low pour point transformer oil. The oil-rich liquid phase behaves like wax during filtration and becomes part of the filter cake which is removed from filter 13 via line 8. The wax cake containing the oil-rich phase is then further processed by any suitable means to separate the high viscosity index oil from the wax. For example, a second stage of miscible filtration can be employed to recover the high viscosity index oil left in the wax cake from the first filter. The second filter can be run under miscible conditions by either increasing the filter temperature towards the miscibility point or by adding further dewaxing solvent (richer in MIBK) to the wax cake so as to raise its solvent to oil ratio and MIBK content. The resulting filtrate and wax cake are sent to solvent recovery so that the recovered high viscosity index oil (from filtrate) and wax can be further refined.

The recovered lube oil products may, if so desired, be subjected to various finishing operations such as clay contacting, hydrofining, acid treatment and the like. In addition, various inhibitors and other additive ingredients may be added in order to provide finished lube oil products.

By the method of the present invention, a high stability, low pour point transformer oil may be obtained from a waxy, paraffinic crude oil such as are obtained from Western Canada, Saudi Arabia, Kuwait, the Panhandle, Tia Juana, etc. By a low pour point is meant at least below −40° F and preferably about −50° F or lower.

The transformer oil fraction employed in the instant invention is generally derived from the waxy, paraffinic crude by a crude oil vacuum pipe still.

However, it is essential to the practice of this invention that the transformer oil fraction taken from the vacuum portion of the crude distillation unit be a relatively narrow cut, low viscosity, paraffinic oil distillate with a viscosity of about 40 to 70 SUS at 100° F, and more preferably about 45 to 65 SUS at 100° F, and most preferably 50 to 60 SUS at 100° F. By narrow cut is meant a cut having a 5 to 95% boiling range of between 595 to 755° F at a pressure of one atmosphere. This cut will contain the low pour point transformer oil fraction sought to be recovered in the present invention. More preferred are fractions exhibiting a boiling range of from about 600 to 750° F and most preferably 600 to 735° F at 1 atmosphere pressure.

These well fractionated, narrow cut, low viscosity distillates are desirable, because when ketone dewaxed (i.e., at −10° F) they exhibit a pour-filter inversion phenomenon in which the pour point of the dewaxed oil can be as low as 30° to 40° F below the dewaxing temperature, in contrast to conventional (broad cut) distillates wherein the pour point is generally about 5° above the dewaxing temperature. This invention refers to narrow cut fractions described above which can be taken from a conventional crude oil vacuum distillation tower. These narrow cut fractions are not narrow enough to give the desired 30° to 40° F pour-filter inversions without further treatment. An additional pour point decrease of 10° F or more below the dewaxing temperature is achieved by the extraction-immiscible dewaxing-filtration steps of the instant invention. Finally, it is important that the transformer oil fraction be obtained as a heart cut from the vacuum crude distillation unit and having a 5 to 95 LV% boiling range of between 595° to 755° F at atmospheric pressure. In general, material boiling in this range will exhibit a pour-filter inversion effect and will contain the desired transformer oil fraction, which most preferably will have a viscosity of from 50 to 60 SUS at 100° F, but which may have a viscosity outside of these limits, depending on the application desired for the oil.

The undesirable aromatic and polar constituents of the transformer oil fraction are removed by contacting or extracting the oil with solvents having an affinity for such compounds. These solvents are well known in the art and include phenol, N-methyl-2-pyrollidone, furfural, NMP/phenol and the like along with up to about 20% of water. The water is employed in the extraction solvent in order to increase the selectivity of same for the aromatic and polar constituents of the oil. Generally, about ½ to 4 volumes of solvent per volume of oil are used in the solvent extraction step. The temperature used is generally in the range of from 120° to 250° F at pressures in the range of about atmospheric up to about 250 psig. In general, the solvent flows downwardly in a vertical extraction tower and counter-currently contacts the up-flowing oil under conditions wherein the more aromatic and polar-type constituents are dissolved in the solvent forming an oil-rich raffinate phase and a solvent-rich extract phase. The downwardly flowing extraction solvent may contain the desired amount of water or, alternatively, the water may be separately injected near the bottom of the extraction unit. The extract phase is removed from the extraction zone and is processed to segregate the solvent from the aromatic and polar-type compounds, with the solvent being recycled either to the extracting zone or to solvent storage. In general, if solvents such as phenol and furfural are used for the extraction, then any solvent which may be entrained in the raffinate phase is removed from said phase prior to the dewaxing operation. However, if N-methyl-2-pyrrolidone is used as the extraction solvent it may not be necessary to remove any solvent entrained in the raffinate phase prior to the dewaxing operation. It is the raffinate from the extraction operation that contains the desired transformer oil fraction.

The raffinate from the extraction is solvent dewaxed using any dewaxing solvents that will form the desired three-phase slurry. It is critical to the instant invention that a three-phase slurry is ultimately fed to the wax filters subsequent to the dewaxing step. For example, the raffinate may be contacted with an autorefrigerative/ketone dewaxing solvent such as propane/MIBK/acetone, propylene/MIBK/acetone, propylene/MEK/MIBK, propylene/MEK/toluene and the like, with the resulting mixture cooled to achieve liquid-liquid immiscibility and precipitation of the wax at least partially by in situ autorefrigerative means. Another dewaxing solvent comprises mixtures of ketones having 3 to 6 carbon atoms with each other or with single ring aromatic solvents such as MEK/toluene. Particularly preferred solvents that have been found useful for producing the desired three-phase, liquid-liquid-solid slurry wherein the solid comprises wax and one of the liquid phases is solvent-rich and contains the desired transformer oil, include the binary mixtures MEK/MIBK and acetone/MIBK.

Figure 2:
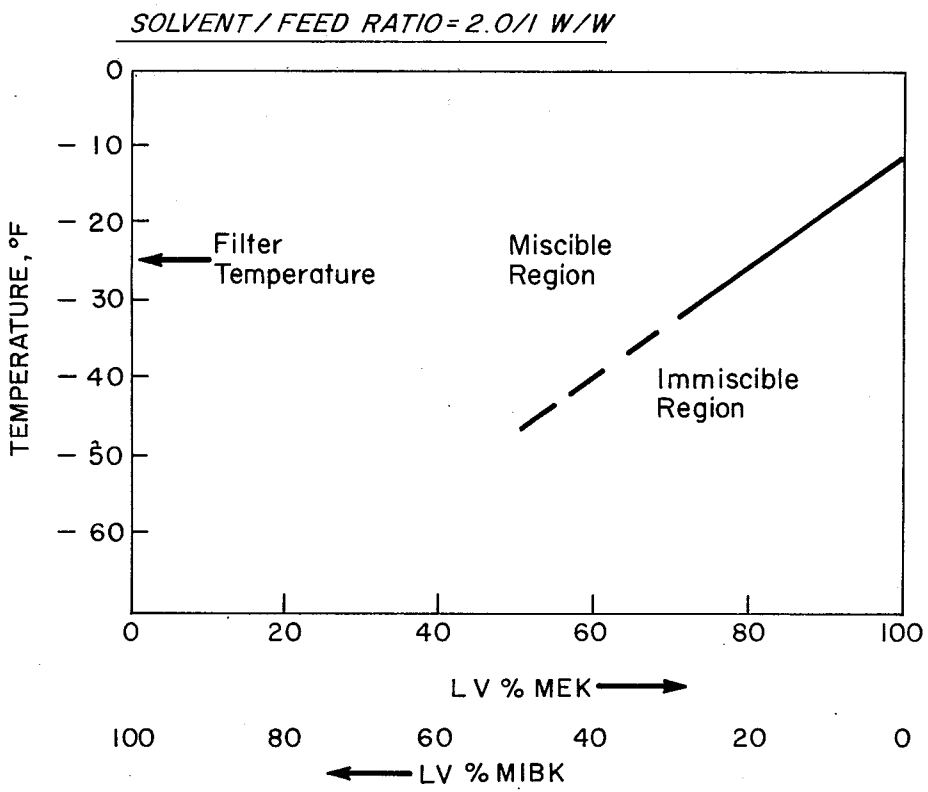
FIG. 2 is a graph illustrating the solubility of a paraffinic oil in mixed ketone solvents.

Parameters controlling formation of the three-phase slurry required to achieve the desired pour point reduction include (1) solvent composition, (2) temperature, (3) oil feed and (4) solvent/oil ratio. The interrelation of these parameters for a Light Arabian raffinate at a solvent/feed ratio of 2/1, using MEK/MIBK as the dewaxing solvent, is illustrated in FIG. 2. In general, the MEK in the MEK/MIBK solvent will range from about 45 to about 95 LV% at filtration temperatures of from about −10° F to −40° F. To ensure immiscibility at filtration temperatures ranging between −10° F to −40° F when using the acetone/MIBK binary mixture, the latter's composition should range between 55 to 95 LV% acetone, preferably between 50 to 75 LV% acetone.

The solvent is normally prechilled before it is mixed with the waxy oil (transformer oil fraction). It is possible to achieve immiscibility and at the same time bring the temperature of the slurry down to the filtration temperature solely by means of injecting cold solvent into the waxy oil. However, more often the waxy oil is partially cooled by mixing same with a cold dewaxing solvent, with additional cooling taking place by other means such as passing the wax/oil/solvent mixture through scraped surface exchangers, etc. which may also be considered as comprising part of the dewaxer. That is, mixing of the oil and solvent may take place under miscible conditions with a single phase resulting, wax precipitation and liquid-liquid immiscibility being achieved by further cooling the final mixture down to the appropriate temperature. It is to be understood of course that the appropriate solvent choice as well as the ultimate temperature to which the mixture and slurry is eventually cooled will depend upon a number of factors such as the nature and composition of the solvent, feed, desired pour point, etc. In general, the temperature to which the slurry is ultimately cooled prior to filtration will be between −10° and −40° F, the preferred temperature being between −15° and −35° F and most preferred −20° and −30° F. The temperature of the slurry as it is being filtered will be that temperature reached prior to filtration, supra. The pour point of the transformer oil product will depend on the feed, dewaxing temperature, solvent, dilution ratio, etc., as hereinbefore described, supra.

The recovered dewaxed oil products may be hydrofined to improve color, oxidation stability and reduce sulfur content. This may be accomplished by contacting the dewaxed oil with a suitable hydrofining catalyst containing the sulfides or oxides of combinations of metals such as cobalt and molybdenum, nickel and molybdenum, nickel and tungsten, etc. In general, hydrofining is accomplished by passing the dewaxed oil over a fixed bed at a space velocity of between 0.3 and 3.0/V/V/Hr. at a temperature between 350° and 650° F and under a hydrogen partial pressure of between 300 and 900 psig. However, this step is not essential for the purposes of this invention and may be omitted.

DESCRIPTION OF A PREFERRED EMBODIMENT

This invention will be more apparent from the preferred embodiment which is illustrated by the following example.

EXAMPLE

Referring to FIG. 1, an Aramco crude was fed thru line 1 to a conventional refinery crude distillation unit 10. A waxy distillate fraction comprising 5.4 LV% of the crude and having a 5 to 95% boiling range of 602 to 737° F (ASTM D-2887-70T), a pour point of +47° F and a viscosity of 56 SUS at 100° F was recovered from the vacuum portion of the crude distillation unit thru line 2 and fed to extraction unit 11. The aromatic and polar constituents were removed from the distillate by contacting same with phenol entering extraction unit 11 via line 3. The volume treat ratio of phenol (containing 8 volume % water) to the distillate fraction was 131 LV%. Twenty-nine LV% of the distillate fraction was removed from the extraction unit as an extract phase via line 4. The remaining 71 LV% raffinate phase was fed to dewaxing unit 12 via line 5. The raffinate was mixed with cold MEK/MIBK dewaxing solvent entering unit 12 via line 6 to a final solvent/oil ratio of 2/1 by weight and a final temperature of −25° F, which resulted in precipitating a substantial amount of wax (19.5 weight %) from the oil. The slurry was then fed to wax filter 13 via line 7 wherein the precipitated wax was separated from the slurry by conventional vacuum filtration. The filter cake and filtrate were recovered via lines 8 and 9, respectively, and the solvent subsequently removed from the filtrate by distillation.

Dewaxing experiments were carried out using MEK/-MIBK compcsitions of 50/50 LV%, 75/25 LV% and 90/10 LV% as shown in Table 1. Immiscibility was achieved by increasing the MEK content of the solvent past 85%, which is approximately the point at which the raffinate is just miscible with the MEK/MIBK mixture at −25° F. Miscibility data is shown in Table 1 and in FIG. 2.

The data in Table 1 show that immiscible liquid-liquid dewaxing yielded a 10° F pour point bonus in that the pour point of the immiscibly dewaxed product was −50° F, as compared to the pour point of −40° F achieved when the raffinate was dewaxed under miscible conditions. The data also illustrate the pour inversion obtained by extracting and then dewaxing the narrow fraction distillate feed of the instant invention, as evidenced by the pour points of the recovered transformer oils being considerably lower than the dewaxing temperature.

TABLE 1

TRANSFORMER OILS FROM PARAFFINIC CRUDE

| Solvent | MEK/MIBK | | |
|---|---|---|---|
| Composition, LV% | 50/50 | 75/25 | 90/10 |
| Solvent/Feed, w/w | — | 2.0/1 | — |
| Filter Temperature, ° F | — | −25 | — |
| ° F from Immiscibility* (M = Miscible; I = Immiscible) | +28(M) | +4(M) | −7(I) |
| Low Pour Point Transformer Oil** | | | |
| Viscosity, SUS AT | | | |
| 100° F | 56.0 | 56.2 | 56.7 |
| 210° F | 34.2 | 34.3 | 34.3 |
| Cloud Point, ° F | −23 | −27 | −29 |
| Pour Point, ° F | −40 | −40 | −50 |

*See FIG. 2. Just miscible with 85/15 LV% MEK/MIBK at −25° F.
**No attempt was made to recover the oil-rich phase from the filter cake.

What is claimed is:

1. A process for producing a low pour point transformer oil which comprises:

a. solvent extracting a waxy distillate fraction of a paraffinic crude, said fraction having a 5 to 95% boiling range of 595° to 755° F at atmospheric pressure, to produce an extract and a raffinate;

b. solvent dewaxing said raffinate at a temperature of from about −10° to −40° F under liquid-liquid immiscible conditions to form a three-phase slurry containing a solid waxy phase, an oil-rich liquid phase and a solvent-rich liquid phase;

c. filtering said slurry at a temperature of from about −10° to about −40° F to form a filtrate substantially comprising the solvent-rich phase which contains the desired transformer oil, and a wax cake containing the oil-rich phase; and d. recovering a low pour point transformer oil from said filtrate only by removing solvent from same.

2. The process of claim 1 wherein the waxy distillate fraction has a viscosity of 40 to 70 SUS at 100° F.

3. The process of claim 2 wherein the waxy distillate has a 5 to 95% boiling range of 600° to 735° F at atmospheric pressure.

4. The process of claim 1 wherein both the dewaxing and filtration occur at from −20° to −30° F.

5. The process of claim 1 wherein the liquid-liquid immiscible conditions are achieved by adjusting the dewaxing solvent composition.

6. The process of claim 1 wherein the liquid-liquid immiscible conditions are achieved by adjusting the dewaxing temperature.

7. The process of claim 1 wherein the dewaxing step includes scraped-surface chilling after mixing the solvent and raffinate.

8. The process of claim 1 wherein the dewaxing solvent comprises at least two ketones selected from the group consisting of ketones having from 3 to 6 carbon atoms.

9. The process of claim 8 wherein the dewaxing solvent is selected from the group consisting of MEK/-MIBK and acetone/MIBK.

10. The process of claim 1 wherein the dewaxing solvent is selected from the group consisting of ketones having from 3 to 6 carbon atoms and mixtures thereof and a single ring aromatic solvent.

11. The process of claim 10 wherein the dewaxing solvent comprises a mixture of MEK and toluene.

12. The process of claim 9 wherein the acetone ranges from 55 to 95 LV% and the MEK ranges from 45 to 95 LV%.

13. The process of claim 1 wherein the dewaxing solvent comprises an autorefrigerant and a binary mixture of ketones having 3 to 6 carbon atoms.

14. The process of claim 13 wherein the autorefrigerant is selected from the group consisting of propylene and propane.

15. The process of claim 1 wherein the recovered transformer oil has a pour point of less than −40° F.

16. A process for producing a low pour point transformer oil from paraffinic oils which comprises:

a. solvent extracting a waxy distillate fraction of a paraffinic crude, said fraction having a 5 to 95% boiling range of 595° to 755° F atmospheric pressure, to produce an extract and a raffinate;

b. solvent dewaxing said raffinate at a temperature of from about −10° to −40° F under liquid-liquid immiscible conditions to form a three-phase slurry containing a solid waxy phase, an oil-rich liquid phase, and a solvent-rich liquid phase, the solvent-rich liquid phase containing the desired transformer oil;

c. filtering said slurry at a temperature of from about −10° to about −40° F to form a filtrate comprising the solvent-rich liquid phase which contains the desired transformer oil and a wax cake containing the oil-rich liquid phase; and d. only removing solvent from said filtrate and thereby recovering a transformer oil from same having a pour point below about −40° F.

* * * * *